US005202739A

United States Patent [19]

Hatakeyama et al.

[11] Patent Number: 5,202,739

[45] Date of Patent: Apr. 13, 1993

[54] IMAGE FORMING APPARATUS HAVING A DEVELOPING MEANS MOVABLE BETWEEN AN OPERATIVE POSITION AND INOPERATIVE POSITION

[75] Inventors: Takuya Hatakeyama, Tokyo; Michiro Kolke, Kawasaki, both of Japan

[73] Assignee: Canon Kabushiki Kaisha, Tokyo, Japan

[21] Appl. No.: 701,315

[22] Filed: May 17, 1991

Related U.S. Application Data

[63] Continuation of Ser. No. 572,420, Aug. 27, 1990, abandoned.

[30] Foreign Application Priority Data

Aug. 30, 1989 [JP] Japan ..... 1-223694

[51] Int. Cl.[5] ..... G03G 15/01; G03G 15/06

[52] U.S. Cl. ..... 355/327; 355/245; 118/645

[58] Field of Search ..... 365/326, 327, 245, 251, 365/253, 256; 118/645, 657, 658, 661

[56] References Cited

U.S. PATENT DOCUMENTS

| | | | |
|---|---|---|---|
| 3,970,383 | 7/1976 | Honda et al. | 355/327 |
| 3,976,372 | 8/1976 | Miyata et al. | 355/327 |
| 3,981,576 | 9/1976 | Inoue | 355/327 |
| 3,985,435 | 10/1976 | Suzuki et al. | 355/327 |
| 4,339,196 | 7/1982 | Beck et al. | 355/3 DD |
| 4,358,195 | 11/1982 | Kuehnle et al. | 355/327 |
| 4,713,673 | 12/1987 | Kessoku | 355/4 |
| 4,746,951 | 5/1988 | Hayakawa et al. | 355/4 |
| 4,928,146 | 5/1990 | Yamada | 355/253 |
| 4,939,548 | 7/1990 | Yamada et al. | 355/326 X |
| 4,969,012 | 11/1990 | Suzuki et al. | 355/326 X |

FOREIGN PATENT DOCUMENTS 59-30272 7/1984 Japan .

*Primary Examiner*—R. L. Moses

*Attorney, Agent, or Firm*—Fitzpatrick, Cella, Harper & Scinto

[57] ABSTRACT

An image forming apparatus is provided with a device for forming an electrostatic image on an image bearing member. A developer develops a latent image formed on the image bearing member and includes a developing unit having a developer carrying member for carrying thereon and supplying a developer to the image bearing member. A moving member moves the developing unit between an operative position and a non-operative position away therefrom. A supporting member supports the developing unit for rotation about an axis, the supporting member rotatably supporting the developing unit at one side and supporting the developing unit at the other side for rotation and movement in a predetermined direction. An urging device urges the developing unit toward the image bearing member adjacent the other side, and a driver applies a driving force to the developer carrying member of the developing unit. When the developing unit is rotated about the axis and moved to the operating position by the moving member, and the driver is operated, the developing unit is urged toward image bearing member about the axis. The developer has a plurality of such developing units.

18 Claims, 14 Drawing Sheets

IMAGE FORMING APPARATUS HAVING A DEVELOPING MEANS MOVABLE BETWEEN AN OPERATIVE POSITION AND INOPERATIVE POSITION

This application is a continuation of application Ser. No. 07/572,420 filed Aug. 27, 1990, now abandoned.

FIELD OF THE INVENTION AND RELATED ART

The present invention relates to an image forming apparatus such as an electrophotographic machine or an electrostatic recording machine, or particularly to an image forming apparatus provided with developing means movable between its operative position and non-operative position.

A movable developing apparatus having developing units wherein a developing unit is selectively moved between its operative position and non-operative position in relation to the image bearing member, is used in a multi-color image forming machine or in a full-color image forming machine.

In a commercialized full-color electrophotographic copying machine, a rotary member supporting plural developing units is rotated to move the selected developing unit to the operative position. The rotary type developing device, however, requires a considerable space for the mounting thereof in the copying machine, and therefore, the copying apparatus necessarily becomes bulky. Additionally, the attitude of the developing units varies due to the rotation of the rotary member, with the result of higher liability of the developer scattering in the developing unit.

In order to solve the problems, U.S. Ser. No. 474,369 which has been assigned to the assignee of the present application has proposed that plural developing units are supported on one movable base, which is moved in a horizontal plane to present the selected developing unit to the operative position.

In this image forming apparatus, the movable base carrying the plural developing units is moved along a predetermined straight line, and the developing unit is shifted in a direction perpendicular to the movement direction of the movable base using the force for moving the movable base to place the developing unit at the operative position.

The present invention relates to the image forming apparatus wherein the developing unit is moved to the operative position where it is positioned correctly, and is directed to the assured positioning.

SUMMARY OF THE INVENTION

Accordingly, it is a principal object of the present invention to provide an image forming apparatus wherein the developing unit is correctly positioned at the operative position, so that the image quality is high without blurness of the image.

It is another object of the present invention to provide an image forming apparatus wherein the vibration occurring during movement of the developing unit to the developing position is minimized.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Figure 7:
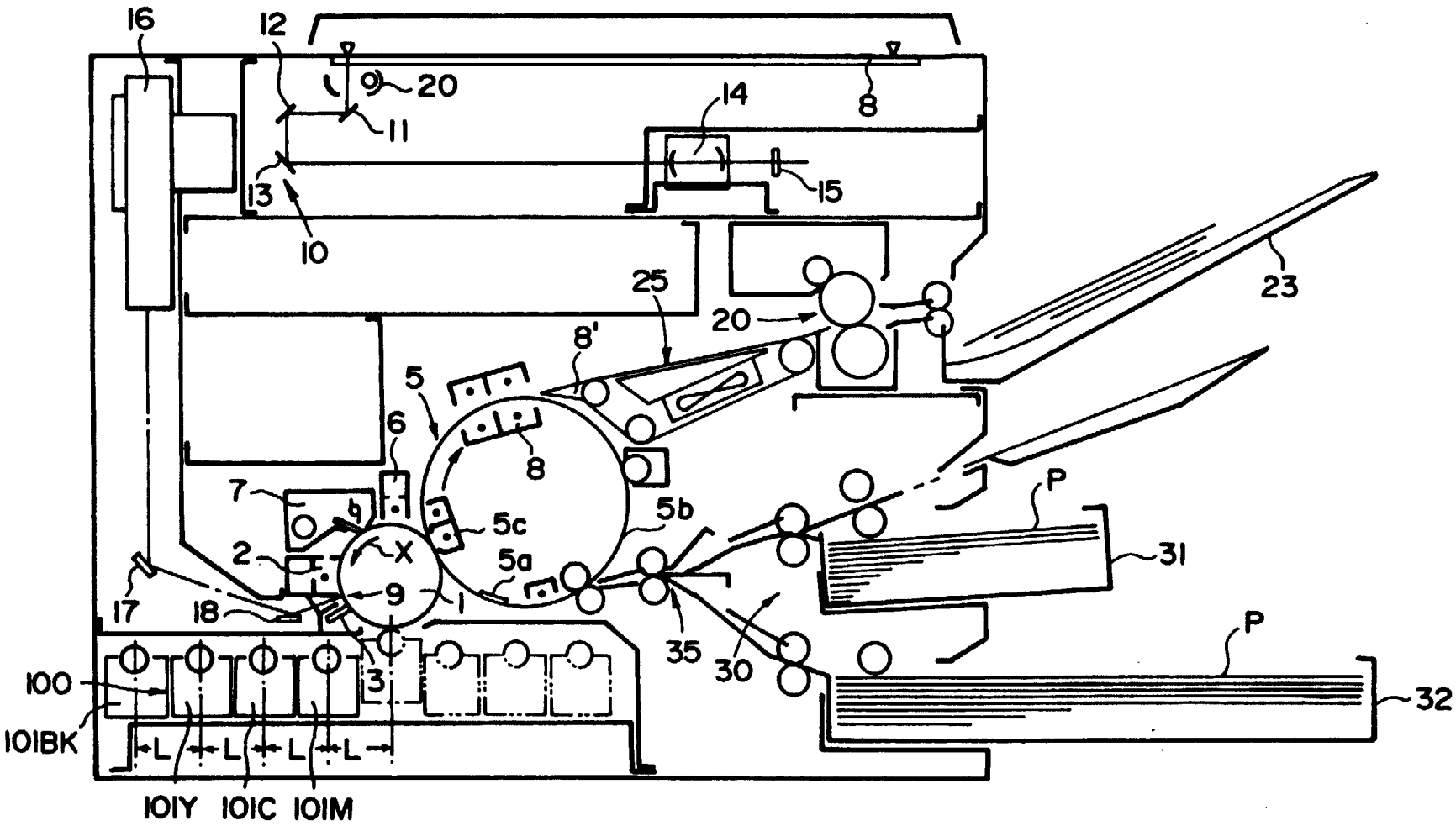
FIG. 7 is a sectional view of an image forming apparatus according to an embodiment of the present invention.

Referring first to FIG. 7, there is shown a full-color electrophotographic copying machine as an exemplary image forming apparatus according to an embodiment of the present invention. The general arrangements will first be described.

The copying machine has an image bearing member in the form of a photosensitive drum rotatable in a direction indicated by an arrow x having a surface electrophotographic photosensitive layer, in this embodiment. The copying machine further comprises a primary charger 2 at the leftside of the photosensitive drum 1, a surface potentiometer 3 for measuring the surface potential of the photosensitive drum 1, a developing device 100 right below the photosensitive drum 1, a horizontally (left-right) movable developing device 100 right below the photosensitive drum 1, the developing device 100 having a plurality of developing units, namely, a developing unit 101M, a developing unit 101C, a developing unit 101Y and a developing unit 101BK, an image transfer device 5 at the upper right of the photosensitive drum 1, a pre-charger 6 for decreasing the deposition force between the photosensitive drum and the residual toner remaining on the surface of the photosensitive drum 1 after the image transfer to make the cleaning operation easier, at a position right above the photosensitive drum 1, and a cleaning device 7 at upper left of the photosensitive drum 1.

At the upper position, there is an optical system 10 to project light information corresponding to the image of the original on the platen 8 onto the photosensitive drum 1 at an image exposure station 9 between the primary charger 2 and the surface potentiometer 3. The optical system 10 may be of any type, and in this embodiment, it comprises a first scanning mirror 11, second and third scanning mirrors 12 and 13 movable in the same direction as the first scanning mirror 11 and and at a speed which is one half that of the first scanning mirror, an imaging lens 14, a CCD 15 integral with B, G and R filters, a laser scanner unit 12 and fixed mirrors 17 and 18. The scanner unit 16 is of a known type which deflects the laser beam by a polygonal mirror, and the detailed description thereof is omitted for simplicity.

In the optical system 10, the light source 19 for illuminating the original moves together with the first scanning mirror 11. Therefore, the reflected light image of the original scanned by the first, second and third scanning mirrors 11, 12 and 13 is passed through the lens 14 and is color-separated by the CCD 15 having B-G-R color separation filter, and is converted into electric signals. The original image information signals are subjected to the image information process including analog-digital conversion or the like, and are supplied to a microprocessor unit (MPU) controlling the entire copying machine, as video signals. The MPU responsive to the signals oscillates a laser beam from the laser unit through the laser driver, and the laser beam thus generated is projected on the photosensitive drum 1 while being imagewisely rendered on and off, thus starting the copy sequential operation.

To the right of the copying machine in this embodiment, there are an image fixing device 20 and a sheet feeding device 30. Between the transfer drum 5 and the fixing device 20 and between the transfer drum 5 and the sheet feeding device 30, there are transfer sheet conveying systems 25 and 35.

With this structure, the photosensitive drum 1 is subjected to the charging, image exposure, developing, image transfer and cleaning operations by the primary charger 2, the optical system 10 and the scanner unit 16, the developing device 100, the transfer device 5 and the cleaning device 7, for the respective color components into which the image is separated by the CCD 15.

Figure 3:
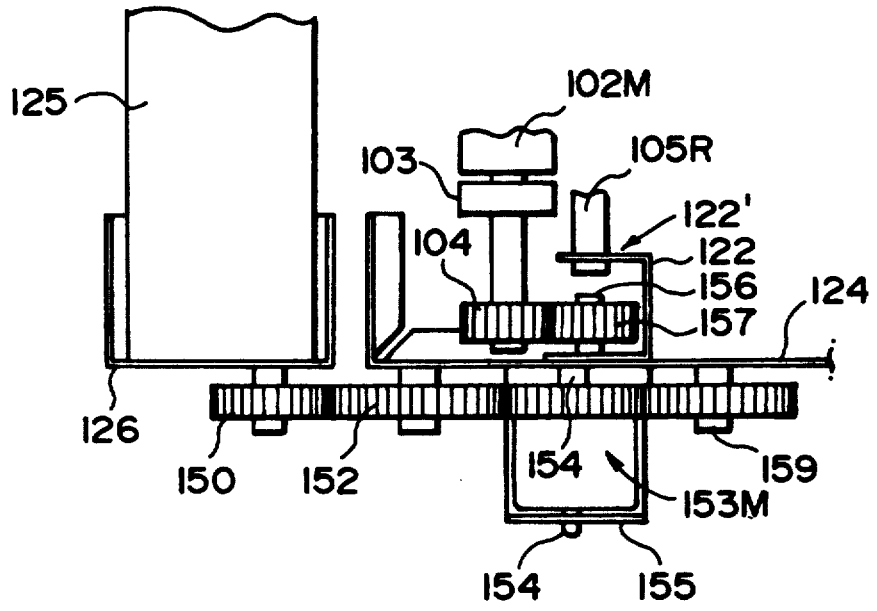
FIG. 3 is a partial top plan view of the system shown in FIG. 2.

The developing device 100, which will be described in detail hereinafter has the developing units 101M (magenta developing unit), 101C (cyan developing unit), 101Y (yellow developing unit) and 101BK (black developing unit), detachably mounted on a movable table 120 (FIG. 3). They function to develop the respective color separated components.

The transfer device 5 is typically provided with a transfer drum 5*b* having a gripper 5*a* for gripping the transfer sheet P (image receiving member) on the periphery thereof. The transfer device 5 catches the leading edge of the transfer sheet P fed through the transfer sheet conveying system 35 from the transfer sheet cassette 31 or 32 of the feeding device 30, and carries by the rotation thereof for transferring the respective color images from the photosensitive drum 1 to the transfer sheet carried thereon. In the image transfer zone, a transfer charger 5*c* is disposed inside the transfer drum 5. In this embodiment, the transfer sheet P is caught by the gripper, but this is not limiting, and it is possible that the transfer sheet P is electrostatically attracted on the transfer sheet carrying sheet 5*b* by electrostatic attracting means.

After the respective visualized images, namely, the toner images are sequentially transferred onto the transfer sheet P, the transfer sheet P is released from the gripper 5*a*, and is separated from the transfer material carrying sheet 5*b* of the transfer drum 5 by the separation charger 8 and the separation pawl 8'. Then, the transfer sheet P is conveyed to the image fixing device 20 by the transfer material conveying system 25. The toner image on the transfer sheet P is fixed on the transfer sheet by the fixing device 20, and the transfer sheet P is discharged to the tray 23.

In this embodiment, the leading edge of the transfer material P is mechanically griped by a gripper. This is not limiting, and another structure is usable such as electrostatic attraction means by means of which the transfer material is electrostatically attracted on the transfer drum.

The description will be made as to the developing device 100 according to this embodiment. The developing device 100 is reciprocable in a horizontal plane, namely left-right direction in the Figure. Each of the developing units is capable of being presented close to the photosensitive drum 1 right below the photosensitive drum 1 with a predetermined clearance. It is desired that each of the developing units is away from the photosensitive drum 1 when it is not at the developing position. Otherwise, when all of the developing units are moved in the vicinity of the photosensitive drum 1, all the developing units are close to the photosensitive drum 1 even when they are returned to the original position (home position) after the developing operations for the four colors are completed. Then, the toner erected on the developer carrying member, that is, the developing sleeve of each of the developing units is contacted to the photosensitive drum, with the result that the unnecessary toner is deposited on the photosensitive drum.

When the unnecessary toner is deposited on the photosensitive drum, the toner is entirely or partly transferred onto the transfer drum 5 to contaminate the transfer drum 5, when there is no transfer material between the photosensitive drum 1 and the transfer drum 5*b*.

Adjacent to the developing operation position for the photosensitive drum 1, there are disposed the surface potentiometer 3 and a baffle plate to prevent the foreign matter such as paper dust onto the developing sleeve of each of the developing units from the above. In order to maintain the predetermined clearance between the developing sleeve and such elements without contact therebetween, each of the developing units is desired to be away from the photosensitive drum 1 when the developing operation is not performed.

The developing device 100 movable in the horizontal plane according to the present invention is such that each of the developing units is in the vicinity of the photosensitive drum 1 only during its developing operation when it is right below the photosensitive drum 1, and otherwise, it is away from the photosensitive drum 1.

Referring to FIGS. 8-16, the developing device 100 will be described in further detail. In this embodiment, the developing units 101 (101M, 101C, 101Y and 101BK) have the same structure, but the colors of the developers therein are different.

Figure 10:
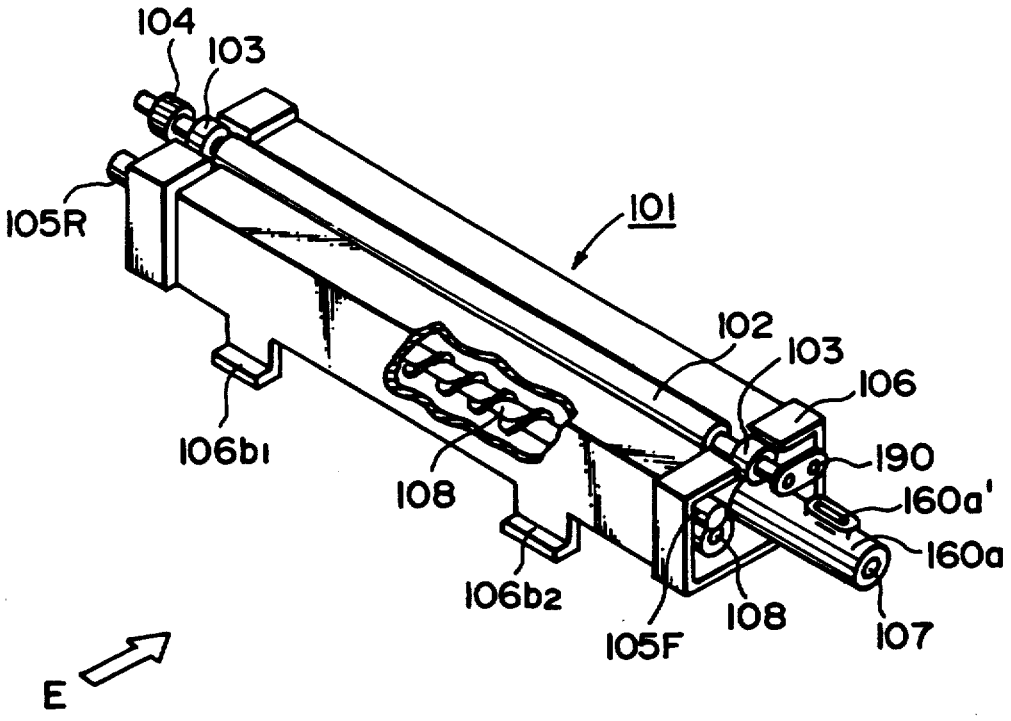
FIG. 10 is a perspective view of a developing unit.

Referring to FIG. 10, the developing unit has an elongated developer container 106 having a rectangular cross-section. In the developer container 106, a developing sleeve 102 having therein a magnet is rotatably supported. At the longitudinal opposite ends of the developing sleeve 102, there are mounted rollers 103 for functioning as spacers maintaining predetermined clearances from the photosensitive drum 1. To one of the longitudinal ends of the developing sleeve 102, a driving gear 104 for driving the developing sleeve 102 is mounted.

The magnet within the developing sleeve 102 is correctly positioned in the developing sleeve 102 by a positioning plate 190 disposed at the other longitudinal end of the developing sleeve.

At the opposite ends of the developer container 106, there are supporting shafts 105F and 105R coaxially in parallel with the axis of the developing sleeve 102. The supporting shafts are effective to position and mount the developing units 101 on the movable table 120 (FIG. 8) which will be described hereinafter. Within the developer container 106, there are screws 107 and 108 (only the shafts thereof are shown) for stirring and conveying the developer in the container. The screws 107 and 108 are driven through the gear train (not shown) by the driving gear 104 of the developing sleeve 102. One of the screws (that is, the screw 107 in this embodiment) is projected to the front side from the developer container 106 at its one end, and the projected portion is connected with a conveying pipe 160 which is in turn connected with a toner supplier 200 (FIG. 13), which will be described hereinafter above the conveying pipe 160, an elongated supply port 106*a*' is formed for connection with the toner supplier 200.

Figure 11:
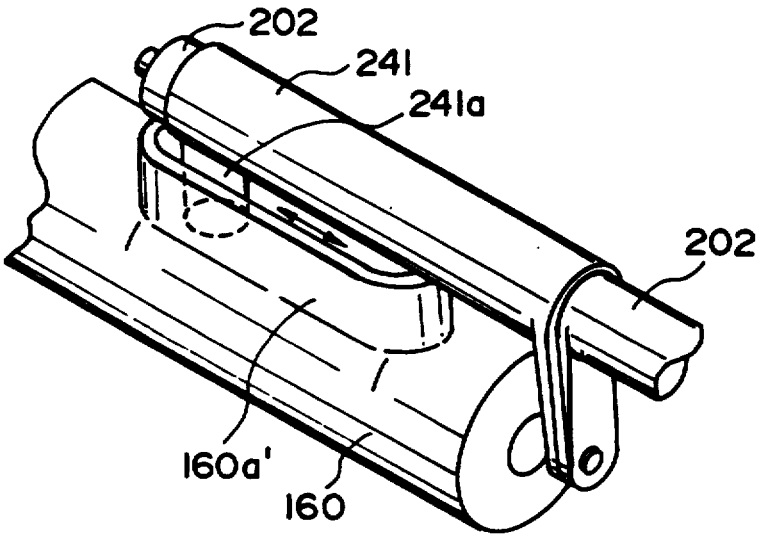
FIG. 11 is a perspective view of a toner conveying type for a toner supplier.

More particularly, as shown in FIG. 11, the supply port 160*a*' of the supply type 160*a* is coupled with a supply port 241*a* of a shutter 241 of the supply type 202 of the toner supplying device 200. Therefore, when the developing unit 101 moves, the supply port 241*a* is guided to the supply port 160*a*' of the developing unit, following the horizontal movement of the unit. Then, the supply type 202 swings to permit normal supply of the toner.

Figure 12:
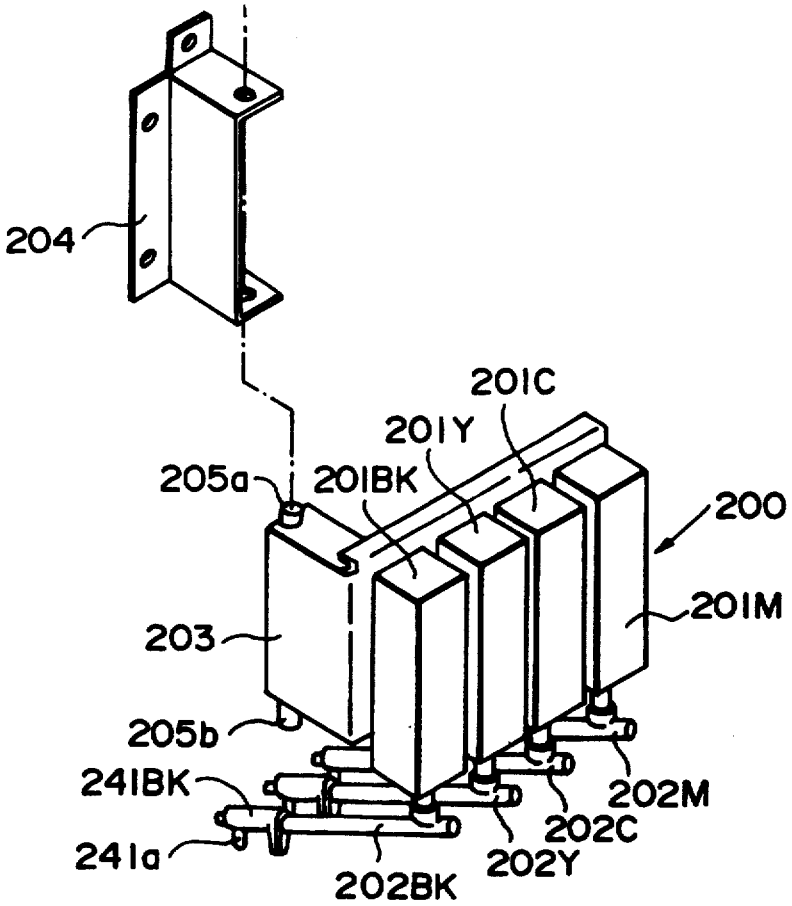
FIG. 12 is a perspective view of a toner supplier.

FIG. 12 shows an example of the toner supply device 200. FIG. 12 is a perspective view showing the general arrangement of the toner supply device 200 without details. The toner supply device 200 has containers 201M, 201C, 201Y and 201BK for containing the magenta developer, the cyan developer, the yellow developer and the black developer, respectively. Supply pipes 202M - BK containing therein respective screws are swingable mounted to the toner containers 201M - BK to supply the toner from the respective container to the developing units 101M, 101C, 101Y and 101BK. The toner supply port 241*a* of the shutter 241 of the supply pipe 202 is engaged with a part of the developing unit, more particularly, with the supply port 160*a*', as described hereinbefore so as to supply the toner to the developer container 106.

The toner container of the toner supply device 200, the supply pipes and other supplying devices are mounted on the supply system supporting plate 203. The supporting plate 203 is rotatably mounted to a supporting base 204 fixedly mounted on a front plate (not shown) of the copying machine by pins 205*a* and 205*b*. When the copying operation is to be effected, the supply system supporting plate 203 is rotated toward the front plate, and is fixed by screws or the like to the front plate at an end opposite from the rotational pivots.

Figure 6:
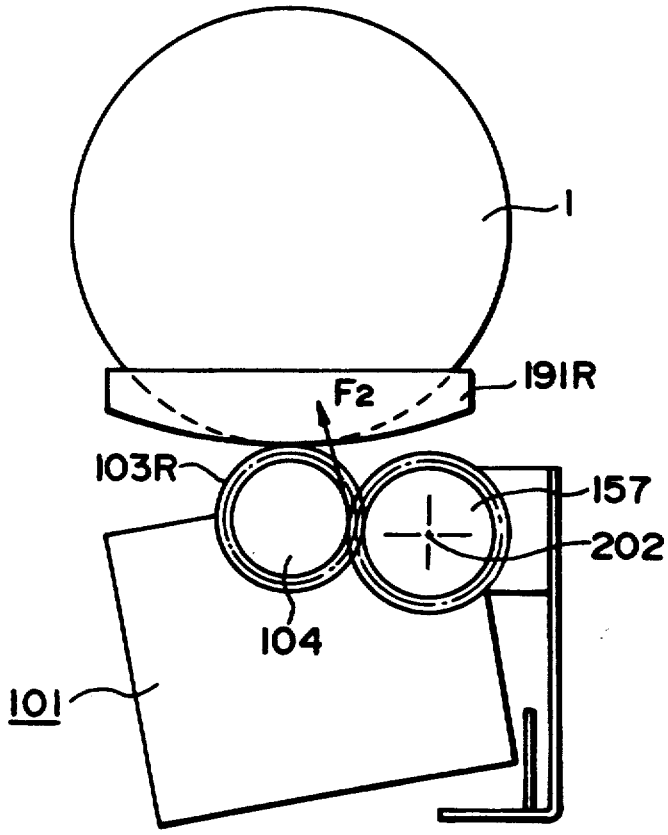
FIG. 6 is a rear view of the apparatus of FIG. 5.

The bottom of the developer container 106 is provided with guiding legs 106*b* (106*b*1 and 106*b*2), 106*c* (FIG. 6). The guiding legs are slidably engageable with a slide guide 121 mounted on the movable table which will be described hereinafter.

Figure 8:
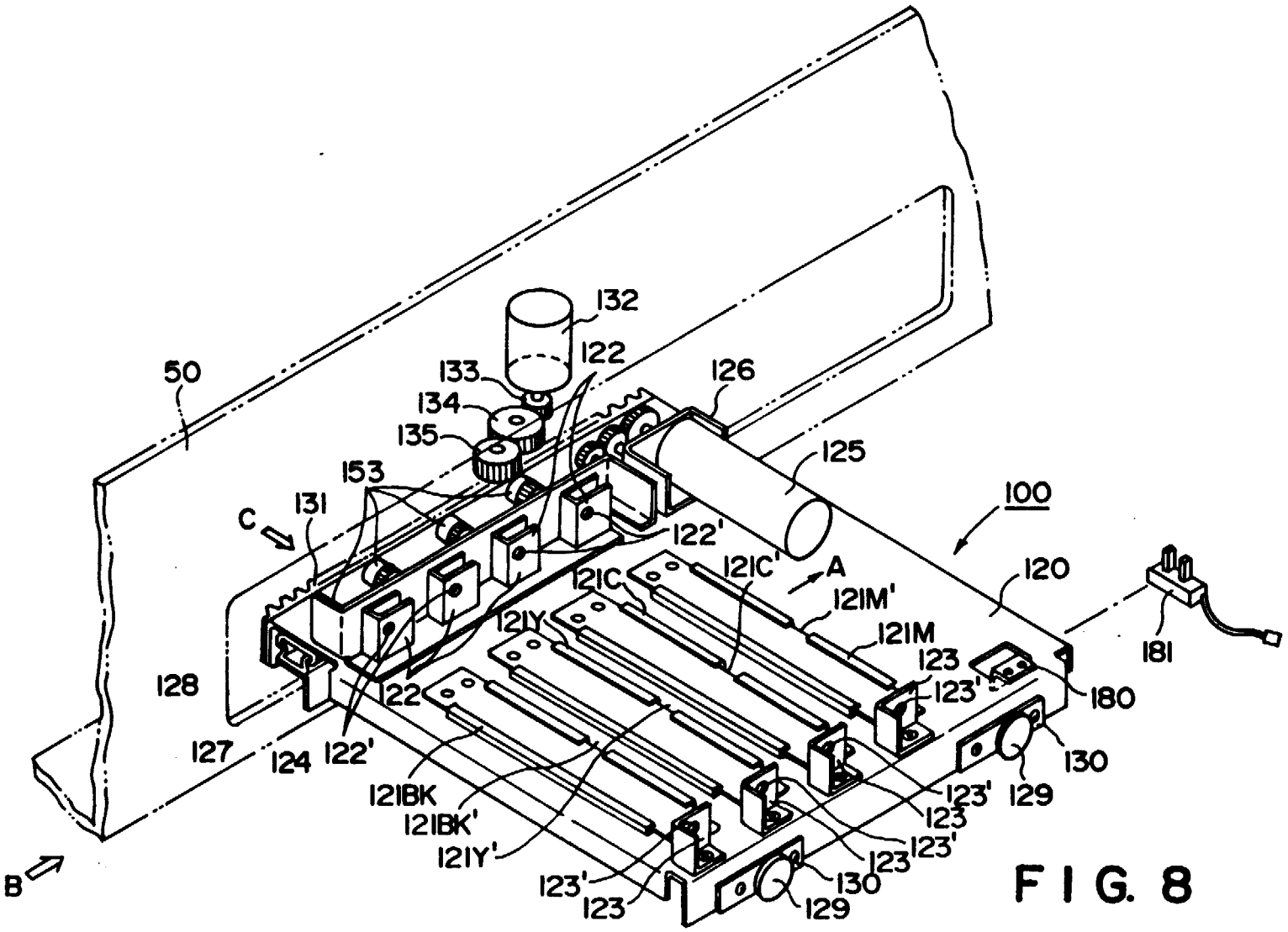
FIG. 8 is a perspective view of a movable base of the developing apparatus.

FIG. 8 is a perspective view of the entire developing device 100 of the copying machine from the front, left and upper position. In this Figure, each of the developing units 101 are omitted for the better understanding.

The developing device 100 has the movable table 120 for carrying the developing units 101. The movable table 120 is provided with the slide guide 121 (121M, 121C, 121Y and 121BK) mounted thereto by screws. The slide guide 121 is engageable with the guiding legs 106*b* and 106*c* of the associated developing unit. It is slidable in the direction indicated by an arrow A.

The movable table 120 has a rear supporting plate 122 and a front supporting plate 123 corresponding to each of the slide guides 121. The rear supporting plate 122 has an opening engageable with the rotational shaft 105R of the developing unit 101, and the front supporting plate 123 has an opening 123' engageable with the rotational shaft 105F of the developing unit 101. After the developing unit 101 is inserted along the slide guide 121, and then the shaft 105R is engaged with the opening 123' of the rear supporting plate 122, the shaft 105F is engaged with the opening 123' of the front supporting plate 123, and thereafter, the front supporting plate 123 is mounted by screws to the base table.

Figure 9:
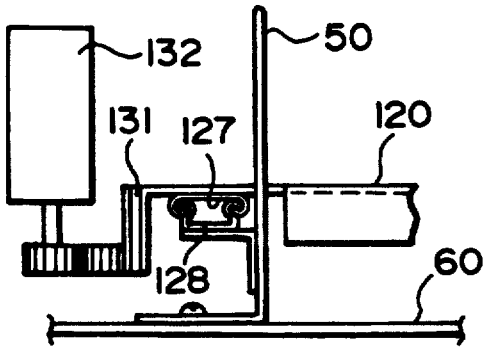
FIG. 9 is a partial side view as seen in a direction B in FIG. 8.

Referring also to FIG. 9, the movable base table 120 is provided with a rail 127 at its rear end. The rail 127 is slidably engaged with a rail supporting table 128 mounted on a rear plate 50 fixed on a bottom plate 60 of the copying machine. On the other hand, to the front end of the base table 120, a roller 129 is rotatably supported through a supporting plate 130. The roller 120 has a bearing therein. The roller 129 is capable of rolling on the base plate 60.

With the above structures, the movable base table 120 is movable relative to the base plate 60 and the rear plate 50.

The driving of the movable table 120 is accomplished by transmitting the driving force of a stepping motor 132 mounted on the bottom plate 60 by an unshown supporting means to a rack 131 fixedly mounted on the base table 120 through a gear train mounted on the supporting means and comprising the gears 133, 134 and 135. The stepping motor 132, gears 133 - 135 are constituted as a unit, which is mounted on the bottom plate 60.

In this embodiment, the developing device 100 is horizontally moved substantially in a tangential direction of the photosensitive drum to the photosensitive drum 1 together with the base table 120, so that a selected one of the developing units is moved to the position substantially right below the photosensitive drum 1, and then, it is raised toward the photosensitive drum 1 and fixed at the operating position with a predetermined clearance from the photosensitive drum 1.

Figures 13, 14:
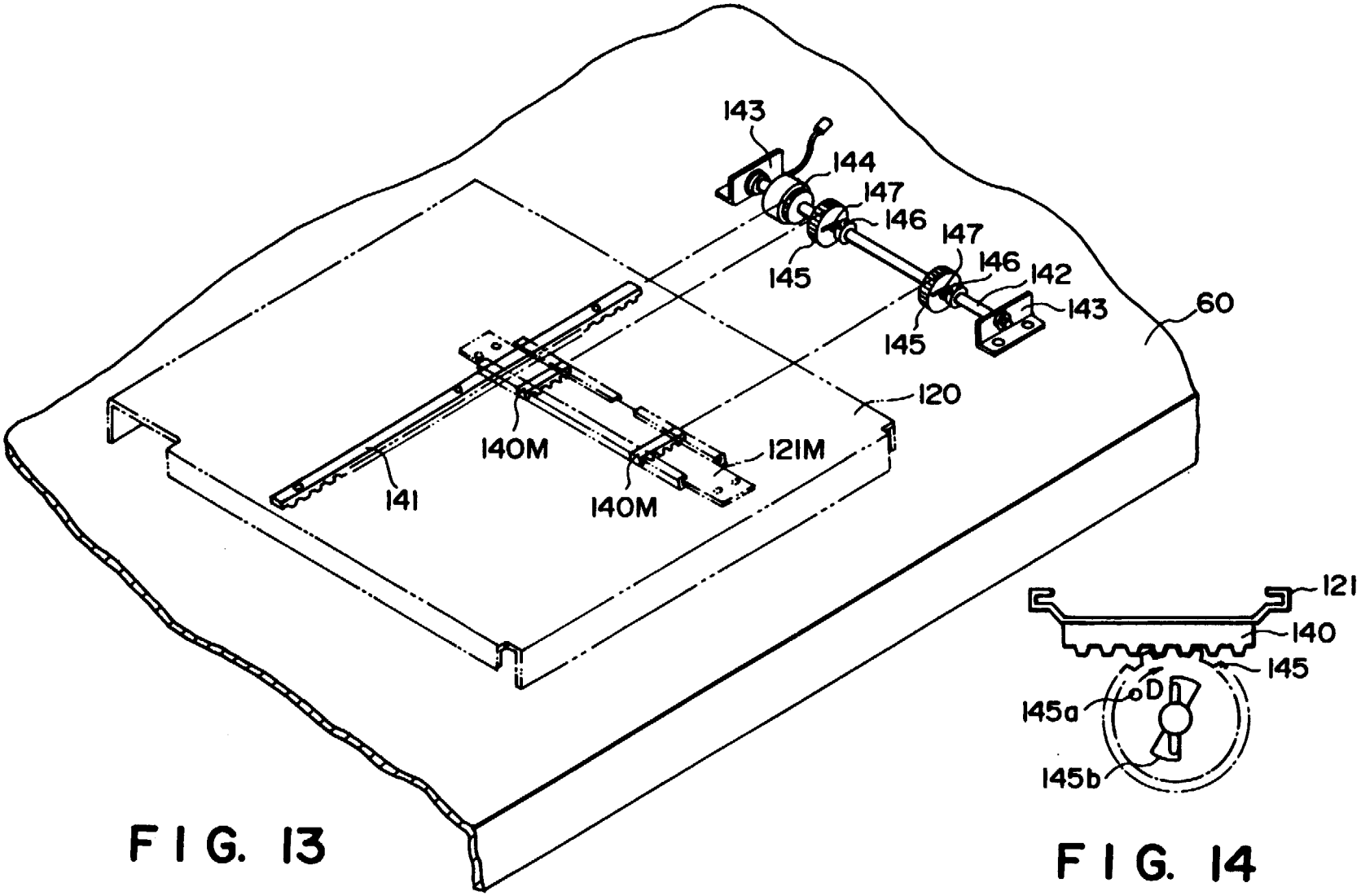
FIG. 13 is a perspective view of a developing unit raising mechanism.
FIG. 14 is a side view of the developing unit raising mechanism.

FIG. 13 is a perspective view illustrating a mechanism for raising the developing unit to position it relative to the photosensitive drum 1. For the purpose of easier understanding, the movable base 120, the slide guide 121M for the developing unit 101M are shown by chain lines, and the slide guides 121C, 121Y and 121BK for the other developing units are omitted.

To the backside of the slide guide 121M, a short rack 140M is fixed, and similar racks 140 are mounted to the slide guides 121C, 121Y and 121BK of the other developing units. In addition, to the backside of the base 120, a long rack 141 is fixedly mounted.

On the other hand, the bottom plate 60 has a rotational shaft 142 rotatably supported by a supporting plate 143. To the shaft 142, a clutch gear 144 is mounted at a position for engagement with the backside rack 141 of the base 120. When a voltage is applied to the clutch gear 144, the rotation of the gear is transmitted to the shaft 142.

To the shaft 142, a gear 145 is mounted at a position for engagement with the rack 140M at the backside of the side guide 121. The number of teeth Z144 of the clutch gear 144 is smaller than the number of the teeth Z145 of the gear 145. The reason for this will be described hereinafter.

Adjacent to the gear 145, a ring 146 is fixedly mounted on the rotational shaft 142, and a coil spring 147 is mounted between the gear 145 and the ring 146. An end of the coil spring 147 is engaged with an unshown groove formed in the ring 146, and the other end, as shown in FIG. 14, is engaged with a hole 145*a* formed in a side of the gear 145. The gear 145 is provided with a parallel pin groove 145*b* in the form of a sector, and the gear 145 is urged in the direction D by the coil spring 147 so that an end of the sector groove is abutted to the parallel pin.

Figure 15:
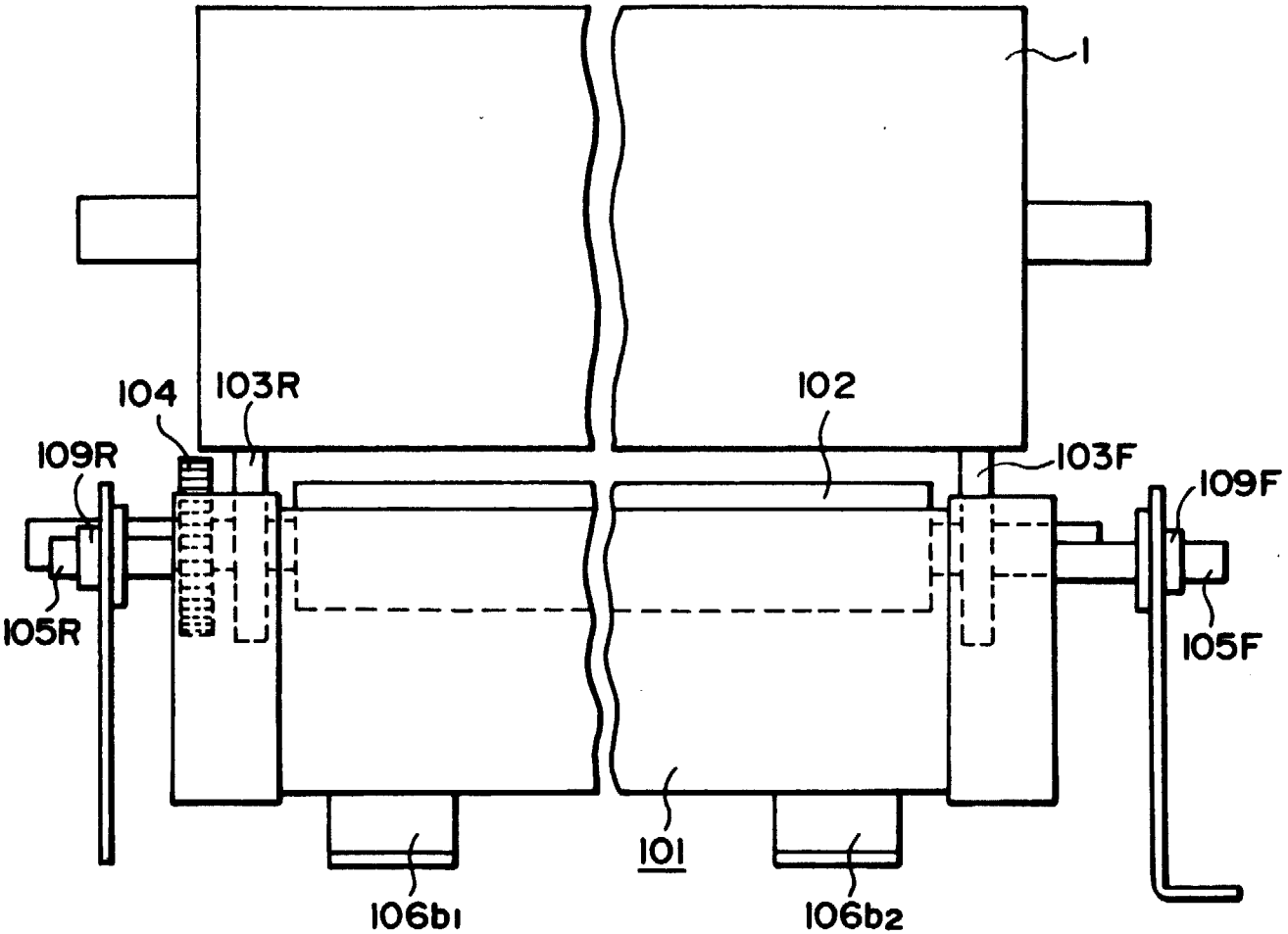
FIG. 15 is a front view of the developing unit and the photosensitive drum illustrating the relationship therebetween.

FIG. 15 shows the relation between the developing unit 101 and the photosensitive drum 1 as seen in the direction E in FIG. 10. When one of the developing units 101 is to perform its developing operation, it is rotated about the pins 105F and 105R until the abutment rolls 103 abut the photosensitive drum, so that it is raised until the gap between the photosensitive drum 1 and the developing sleeve 102 becomes a predetermined level.

In the structure described above, when the main switch of the copying machine is actuated, the discrimination is made as to whether or not the base 120 is at the home positions or not. The discrimination is accomplished, as shown in FIG. 8, by a sensor 181 constituted by a light emitting element and a light receiving element fixedly mounted on the bottom plate 60 and a light blocking plate 180 adjustably mounted to the base 120. If the base 120 is not at the home position, the stepping motor 132 rotates to move the base 120 until the light of the sensor 181 is blocked by the blocking plate 180, that is, until it reaches the home position.

Figure 16:
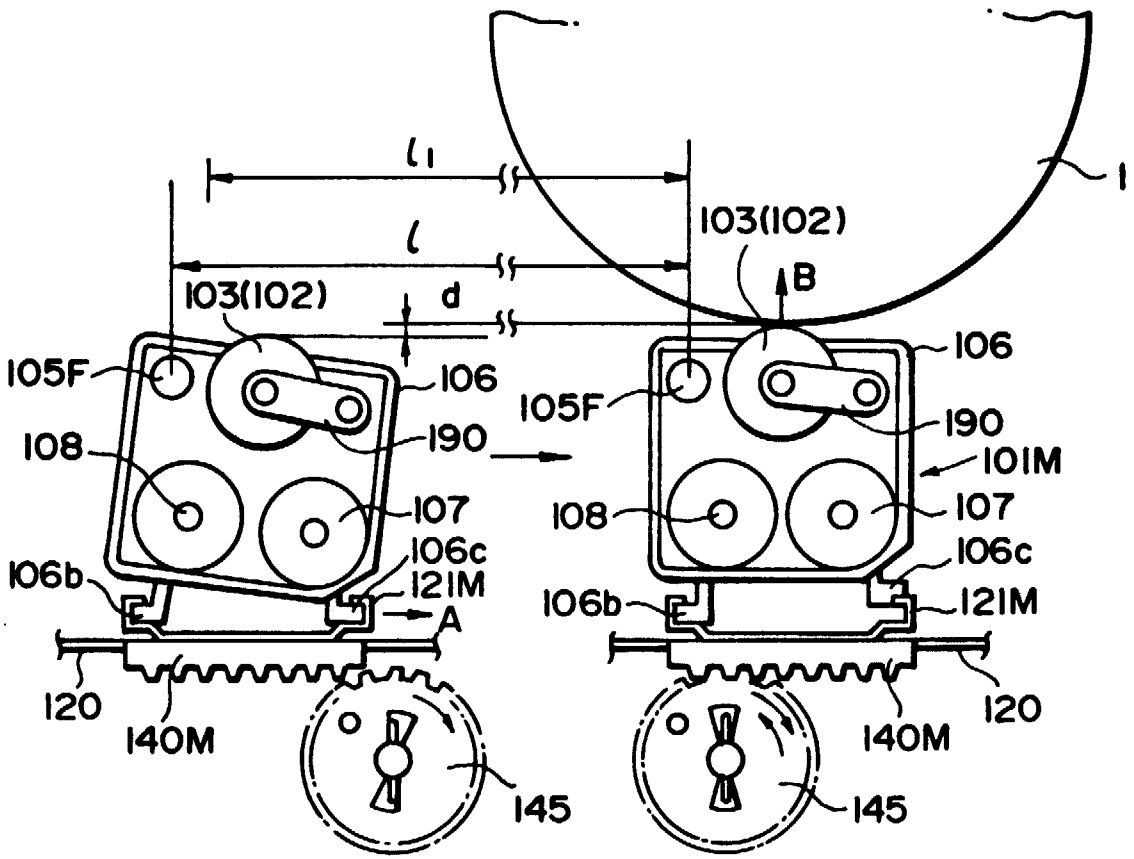
FIG. 16 is a side view of the developing unit raising mechanism.

Referring to FIG. 16, the further description will be made. The home position is set to be the position where the magenta developing unit 101M is away from right below the photosensitive drum 1 toward left as seen from the front by a distance 1, where 1 is a distance between the pin 105F when the developing sleeve 102 is right below the photosensitive drum 1 and a pin 105F when it is at the home position, and is equal to the intervals between adjacent developing units. The position is adjusted by adjusting the light blocking plate 180.

When a copy button is actuated to start the copying operation, the microprocessor unit (MPU) for controlling the operation of the main assembly of the copying machine supplies a signal to a pulse generator for the stepping motor 132 for driving the base 120 to displace the base 120 at a predetermined speed until the developing sleeve 102 of the magenta developing unit 101M is placed right below the photosensitive drum 1. Then, the pulse generator produces pulse signals corresponding to the movement distance and the moving speed, and the pulse signals are reformed and distributed by the driver of the stepping motor 132, so that the electric current is supplied to the coils of the stepping motor in a predetermined sequence for the respective pulses, by which the motor 132 is rotated.

The stepping motor 132 stepwisely rotates by a predetermined angle in accordance with the number of input pulses, and the angular error is extremely small, and therefore, the stop position of the base 120 is very accurate, so that the influence to the image due to the variation in the stoppage accuracy is negligible.

Together with movement of the base 120, the magenta developing unit 101M is raised to approach the photosensitive drum 1. The raising operation will be described in detail.

Referring back to FIG. 13, as described hereinbefore, the rack 141 and the clutch gear 144 are in meshing engagement with each other at the home position of the base 120. Immediately before the base 120 starts its movement, the clutch of the clutch gear 144 is shifted to an engaging position, so that the shaft 142 and the gear 145 rotate together with the movement of the base. During the movement of the base 120, the racks 140 fixedly mounted on the bottom of the slide guide 121 are brought into meshing engagement with the rotating gears 145.

The number of teeth Z144 of the clutch gear 144 is smaller than the number of teeth Z145 of the gear 145. Therefore, if it is assumed that the position where the rack 140 starts to mesh with the gear 145 is away by $l_1$ (FIG. 16, $l_1<1$), the clutch gear 144 rotates through a distance $l_1$ on a pitch circle thereof when the base 120 moves through the distance $l_1$. The distance $l_1$ is converted to a rotational angle of the shaft 142 as follows.

$$\alpha = l_1/r144 \ (rad)$$

where r144 is a radius of the pitch circle of the clutch gear 144.

Therefore, the circumferential length on the pitch circle through which the gear 145 rotates, that is, the movement distance $l_2$ of the slide guide 121M integral with the rack 140 meshed with the gear 145 is $$\begin{aligned} l_2 &= \alpha \times r145 \\ &= l_1 \times (r145/r144) \end{aligned}$$

where r145 is a radius of the pitch circle of the gear 145.

Here, Z145>Z144, that is, r145>r144, and therefore, $l_2>l_1$. Thus, from the start to the end of the $l_1$ movement of the base 120, the slide guide 121M slides relative to the base 121 by the distance $l_2-l_1$. By the movement by $l_2-l_1$ of the slide guide 121M relative to the base 120, as shown in FIG. 16, the slide guide 121M pushes the leg 106*b* of the developing unit 101M which is rotatable on the base 120 about the pins 105F and 105R.

As a result, the magenta developing unit 101M is raised in the direction B during the movement of the base 120 and is stopped at a position close to the photosensitive drum 1 at a position right below the photosensitive drum 1 by the abutment rollers 103. At the time of the raising movement, the leg 106C of the developer container 106 moves away from the slide guide 121M, as will be understood from the Figure, and therefore, as shown in FIG. 8, the slide guide 121 has a cut-away portion 121M' corresponding to the leg 106C to permit this movement.

In order to urge the abutment rollers 103 to the photosensitive drum 1 with a predetermined pressure, the distance through which the developing unit 101M is raised in the direction B is $d+\alpha$ ($\alpha$: positive), where d is a distance between the abutment rollers 103 and the surface of the photosensitive drum at the home position. To provide the proper raising distance, one skilled in the art determines the number of teeth of the gears 145 and 144 in consideration of the movement distance.

When the developing unit 101M is positioned closely to the photosensitive drum 1 through the abutment roller 103 right below the photosensitive drum 1, the developing unit 101M receives a reaction force from the photosensitive drum 1, corresponding to the distance $\alpha$. The gravity force applied to the developing unit is added to the reaction force. The sum of the forces tends to rotate the developing unit 101M about the pins 105F and 105R in the clockwise direction, and therefore, the slide guide 121M is pushed to the left (opposite from the direction A) by the leg **106*b* of the developer container. By this, the rack 104M meshed with the slide guide 121M tends to rotate the gear 145 in the counterclockwise direction. The gear 145, as described hereinbefore, is urged in the direction D by the coil spring 147. However, the coil spring flexes until the reaction force from the photosensitive drum 1 and the movement of the developing units are balanced with the urging force by the coil spring. The flexibility is provided by the parallel pin groove 145*b* in the sector form of the gear 145**.

The wire diameter and the number of windings of the coil spring 147 are determined so that the reaction force from the photosensitive drum 1, that is, the pressing force of the abutment rollers 103 to the photosensitive drum 1 is a predetermined proper force. The rotational shaft 142 is coupled with the stepping motor 132 through the clutch gear 144, the rack 141 and the rack 131. The self-retaining force of the stepping motor 132 acts on the rotational shaft 142, so that the correct movement of the base is accomplished without influence of the rotation of the gear 145.

In the manner described above, when the developing unit 101M is raised, the abutment rollers 103 are press-contacted to the photosensitive drum 1 with a predetermined force, the developing sleeve 102 is placed close to the photosensitive drum 1 with a predetermined clearance therebetween.

When the developing action for the magenta color is completed, the clutch gear 144 (FIG. 13) is disengaged. This releases the rotation of the shaft 142, so that the gear 145 integral therewith becomes freely rotatable. Then, the reaction force from the photosensitive drum 1 and the gravity applied to the developing unit 101M causes the leg **106*b* of the developer container 106 to push the slide guide 102 back, that is, to the left. Thus, the developing unit 101M returns to the lower position shown at the left of FIG. 16 to be away from the photosensitive drum 1**.

Subsequently, the stepping motor 132 rotates through a predetermined amount, and the clutch gear 144 is engaged, by which the cyan developing unit 101C is raised right below the photosensitive drum 1. Then, the developing sleeve 102 is driven to effect the cyan color developing operation.

In the similar manner, the yellow and black developing operations, and the image transfer operation for the respective colors on the same transfer material, are performed, and then, the transfer sheet is separated from the transfer drum 5 by a separation charger 8 and the separation pawl 8'. It is then fixed by an image fixing apparatus and is discharged to the discharge tray 23, so that the copy operation is completed.

As described in the foregoing, since the developing device is movable in a horizontal plane below the photosensitive drum, the developing device may be located below the transfer drum, and the developing sleeve is at the upper portion of the developer container. Therefore, the scattering of the toner and carrier can be suppressed much more than in conventional full-color electrophotographic copying machines. Thus, the necessity for preventing the toner and carrier scattering and for cleaning the apparatus can be eliminated, and in addition, no large rotatable member can be eliminated. As a result, a small size low cost full-color copying machine can be produced.

In the developing apparatus of the above embodiments, the plural developing units are not supported on a rotatable frame, but are supported for horizontal movement, and therefore, the developing units are not reversed. For this reason, the behavior of the developer in the developing units are stabilized, whereby the control of the toner and carrier mixture ratio (T/C ratio) can be performed more accurately than in the conventional apparatus. This enables the stabilized images to be produced at all times, which will be also desired by the users.

When the above described advantageous structure is employed, the developing units are located below the photosensitive drum, and the selected developing unit is raised to the photosensitive drum. In this respect, the following problems have been found.

Referring to FIG. 15, the developing unit 101 are supported at four positions, more particularly, by the front side pin 105F, the rear side pin 105R, a front side abutment roller 103F and a rear side abutment roller 103R. If the supporting pins 105F and 105R are fixed, one of the abutment rollers 103F and 103R is not abutted as long as the drum axis and the developing unit axis are not completed parallel to each other.

Even if the parallelism between the axis of the photosensitive drum and the axis of the developing unit using proper tools, they can not be completely parallel, so that it is difficult to assure the gap between the photosensitive drum 1 and the developing sleeve 102 on the order of several hundreds microns. Additionally, the assembling operation is difficult, and the number of parts for the adjustment is increased.

The possibility of using a flexible structure for the developing unit particularly for the developer container is considered. However, it is difficult from the standpoint of properly sealing the magnet roller, assuring the sealing of the screw shaft and assuring the accuracy of the gap between the drum and the sleeve.

Figure 17:
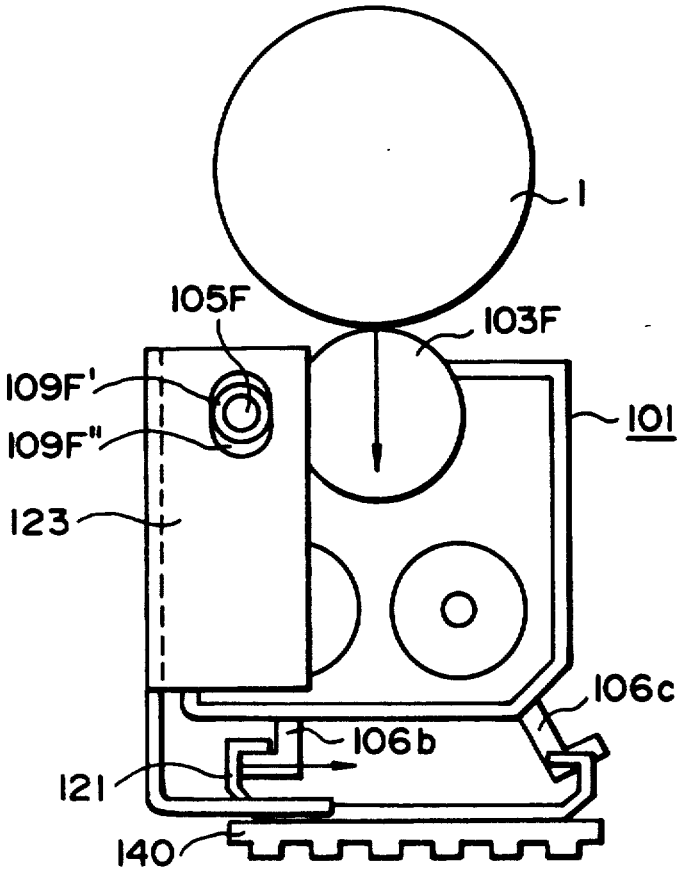
FIGS. 17 and 18 are side views illustrating a comparison example of a developing unit in an image forming apparatus.

FIG. 17 shows a generally used solution to such a problem, in which one of the front and rear pins are supported with play.

More particularly, the front side pin 105F is received by a bearing 109F', and the bearing 109F' is supported in a hole 109F'' elongated in the vertical direction, the hole being formed in a supporting plate 123 securedly mounted on the main assembly of the developing apparatus.

Figure 18:
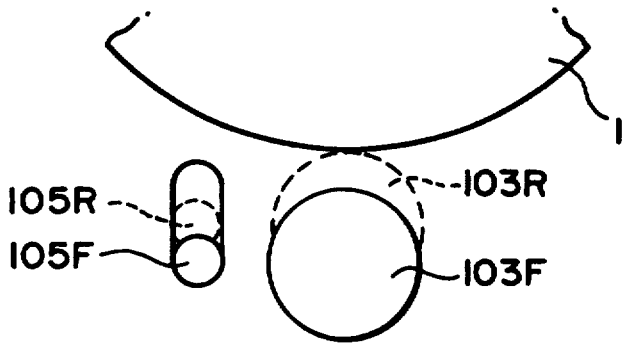

However, the inventors' experiments have shown that the front side pin 105F does not rise from the bottom end of the elongated slot, as schematically shown in FIG. 18, with the result that the abutment roller 103F did not contact the photosensitive drum.

Figure 19:
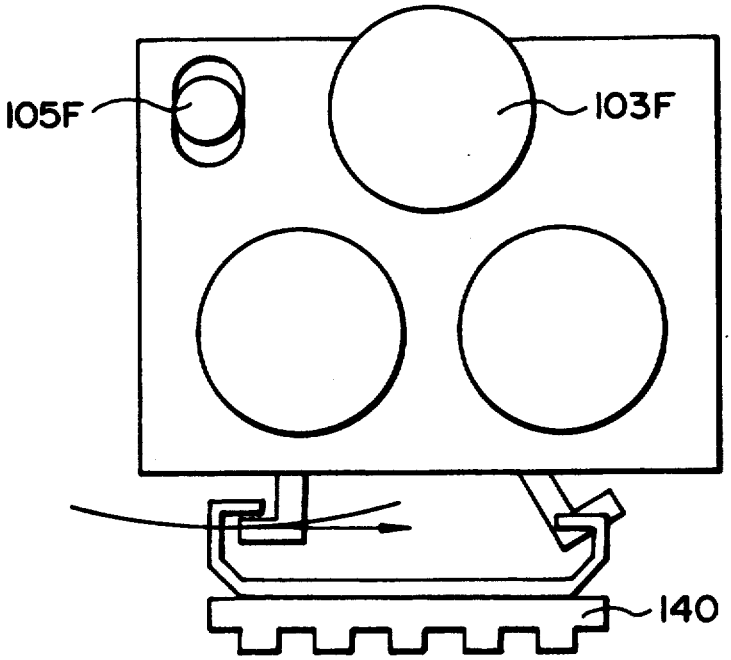
FIGS. 19 and 20 are side views of another comparison example of a developing unit in an image forming apparatus.

FIG. 19 shows the analysis for the reason. As will be understood, the reason is that the raising force for the developing unit is in the direction tangential to the movement track of the developing unit rotation from the standpoint of most efficient rotational movement, so that the force for raising the pin 105F is hardly applied.

Figure 20:
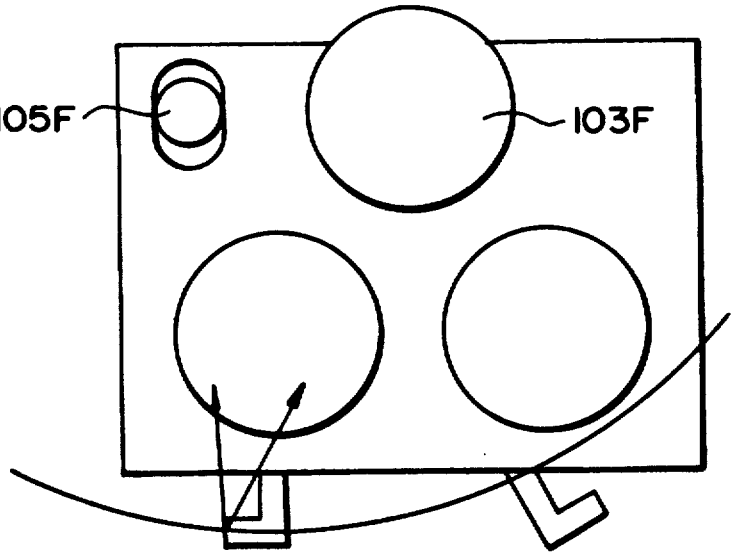

FIG. 20 shows an example of a solution, in which the upward force enough to bear the weight of the developing unit is applied at a position right below the pin 105F. Then, the component of the force effective for the rotation is reduced, so that the raising mechanism has to apply to the developing unit the force which is larger by the corresponding degree, with the result of increased load to the raising mechanism, so that it is most desirable.

Figure 21:
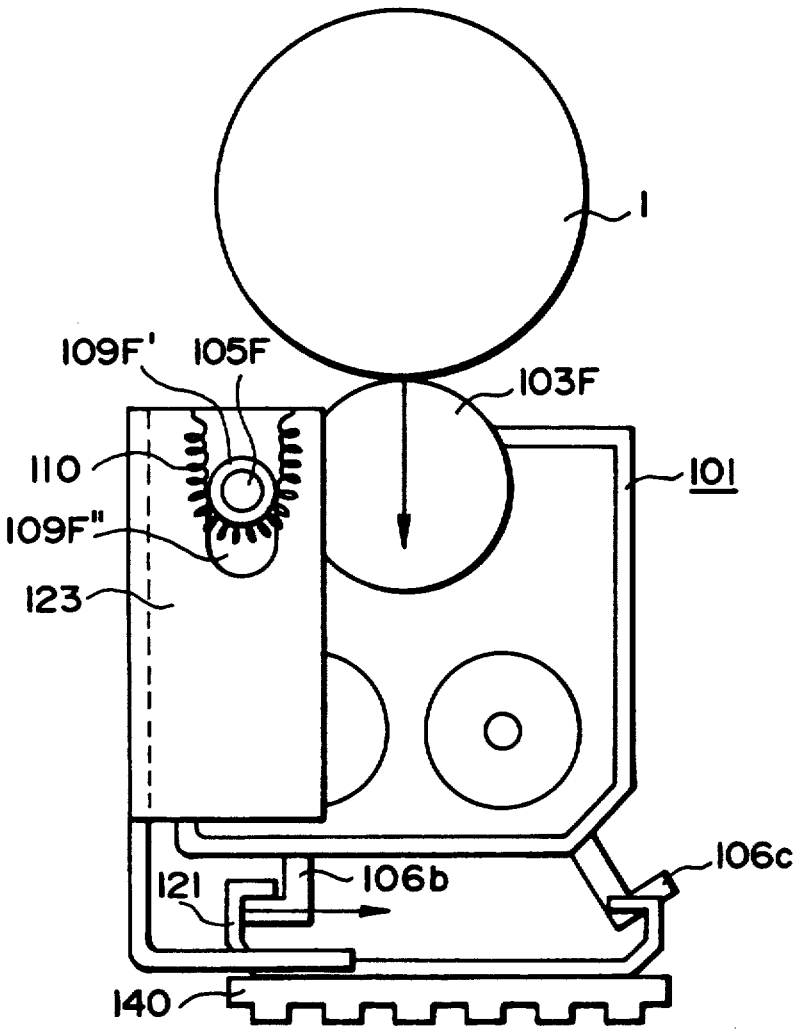
FIG. 21 is a side view of an embodiment of a developing unit raising mechanism in an image forming apparatus.

FIG. 21 shows the structure by which the above described problems are avoided. In this structure, the bearing 109F' supporting the front pin 105F is raised to the top end of the vertically elongated slot 109F'' against the weight of the developing unit 101 by the urging force of the spring 110. Since the front side pin 105F is at a position above the rear pin 105R, the front abutment roller 103F first abuts the photosensitive drum 1 when the developing unit swings.

The force of the slide guide 121 to the leg **106*b* produces a moment about the pin 105F, and a force is applied to the photosensitive drum 1 by the abutment roller 103F, so that the developing unit 101 receives a reaction force in the downward direction. By the downward force, the pin 105F lowers against the raising force of the spring 110** until it is stopped when the rear abutment roller is abutted to the photosensitive drum so that it is supported at the three points, namely, the two abutment rollers and one of the pins.

Using the above described mechanism, the developing device movable in the horizontal plan can be placed below the photosensitive drum, and any selected one of the developing units thereon can be shifted toward the photosensitive drum.

However, the elastic force of the spring 110 for raising the pin 105F is required to be relatively large, and therefore, a correspondingly large force is required to be applied to the developing unit to overcome it. This will be described in further detail.

With the U-shaped spring 110 as shown in FIG. 21, it is difficult to provide a correct spring force. If the spring force is enough to provide the required raising force, the front pin is not fixed, so that the pivot moves when any swinging force is applied to the leg **106*b* of the developing unit, and therefore, the front abutment roller 103F is not abutted with sufficient abutment force, even to such an extent that the abutment roller 103F** is not contacted to the drum.

In order to assuredly raising it, the spring force of the spring 110 is desired to be sufficiently large with ample safety factor. The position of the front pin 109F' at the time when the developing unit it raised may be closer to the top end of the elongates slot 109F'' or to the bottom end thereof, corresponding to the inclination of the rotational axis relative to the axis of the photosensitive drum. The spring force is required to be set such that the sufficient spring force can be provided even if the bearing 109F' is close to the top end of the elongated slot 109'', and therefore, the expansion of the spring 110 is small. Therefore, when the bearing 109F' is close to the bottom end of the elongated slot 109F'', and therefore, the expansion of the spring is large, the force required for expanding the spring 110 is further increased. For this reason, too, the spring force of the spring 110 tends to be large. In the raising operation of the developing unit described in conjunction with FIG. 21, the front abutment roller 103F first abuts the drum, and then, the raising spring 110 is expanded by the moment provided by the pushing force of the slide guide 121 to the left **106*b*, by which the rotational axis becomes parallel to the axis of the photosensitive drum. As described hereinbelow, if the spring force of the raising spring 110** is large, the force required for rotating the developing unit is large, correspondingly, so that the load to the raising mechanism is increased.

More particularly, in order to assure the mechanical strength of the racks and gears for driving the slide guide 121, high strength materials and large gear width are required with the result of increased cost and increased space.

In this embodiment, the developing unit raising force is provided by the driving system for the movable base 102 for carrying the developing unit, and therefore, the load to the base driving motor is increased. If the raising force is further increased, the impact or shock caused upon abutment of the abutment rollers 103F and 103R to the photosensitive drum 1 becomes large with the result of non-uniform pitch of the image and misregistration of the color, thus degrading the image quality. In addition, the noise is increased.

According to an embodiment of the present invention, the driving mechanism for the developing sleeve is improved to solve the above problems.

Figure 1:
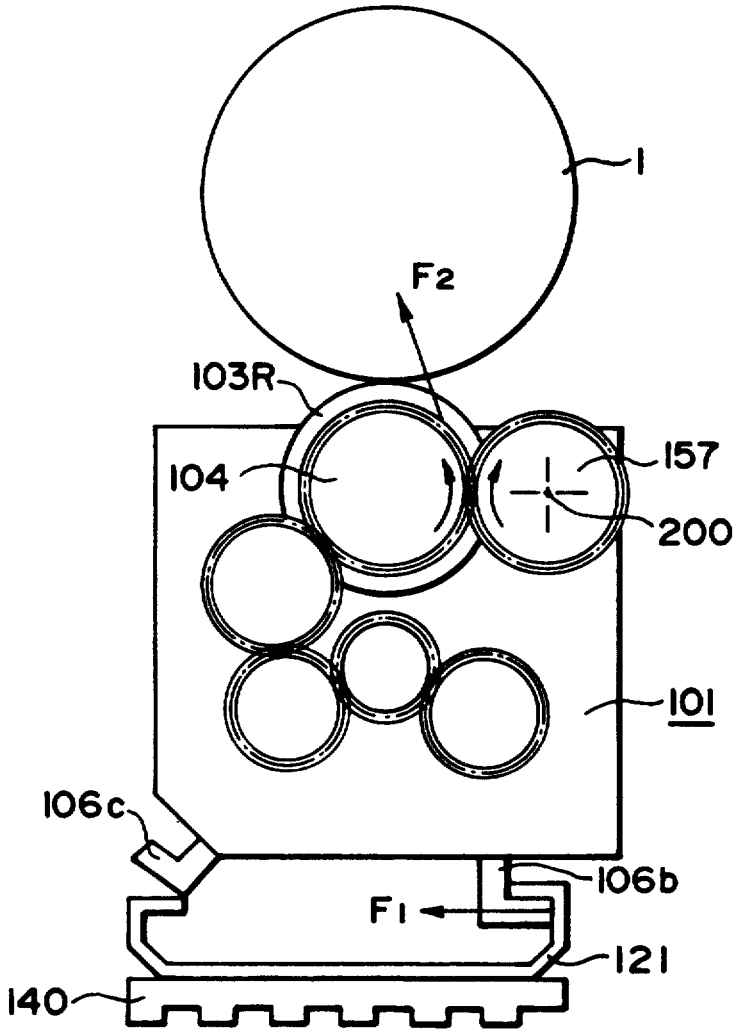
FIG. 1 is a side view of a developing apparatus having a developing unit raising mechanism in an image forming apparatus according to a first embodiment of the present invention.
Figure 2:
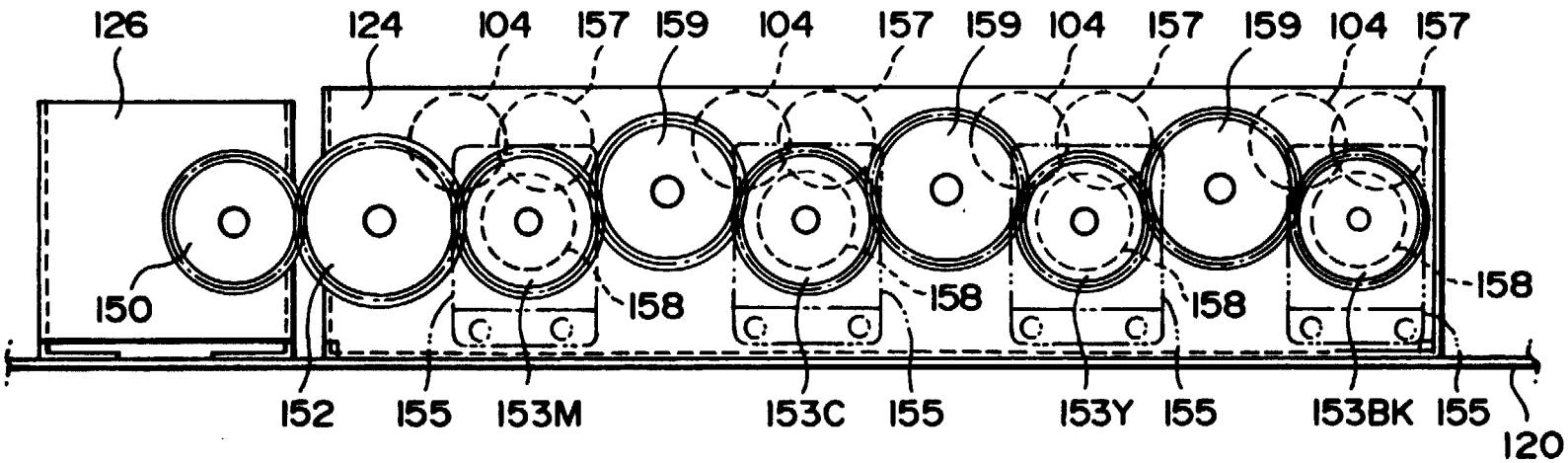
FIG. 2 shows a driving system for the developing apparatus of FIG. 1.

FIGS. 1, 2 and 3 illustrate a developing apparatus 100 according to an embodiment of the present invention.

Referring to FIG. 9, in this embodiment, the rear supporting plate 124 supports the driving gears and clutches which will be described in detail hereinafter and also supports a supporting plate 126 for supporting the motor 125 for driving the developing sleeve. FIG. 2 shows a driving system as seen from the front side of the rack 131, that is, in the direction C in FIG. 8, and FIG. 3 is a top plan view thereof.

Referring to FIGS. 2 and 3, the output of the motor 125 in this embodiment is transmitted from its output gear 150 to the idler gear 152 mounted on the drive base 124, and further to a clutch gear 153M which has a rotational shaft 154 rotatably mounted on the drive base 124 and the supporting plate 155 and which selectively transmits the driving force to the developing sleeve 102. The driving force from the clutch gear 153M is transmitted through the rotational shaft 154 and the output gear 158 to the gear 158 mounted on the drive base 124. The gear 158 is meshed with the driving gear 157 for the developing sleeve to transmit the force thereto from the motor. At this time, the shaft 156 of the gear 157 is coaxial with a hole 122' formed in the rear shaft supporting plate 122 cramped on the rear supporting plate 124.

When the magenta developing unit 101M is inserted along the sliding guide 121M, the shaft 105R of the developing unit 101 is engaged with the hole 122' of the rear supporting plate 122, as shown in FIG. 3 (top plan view), by which the developing sleeve driving gear 157 and the gear 104 mounted to the end of the developing sleeve 102 are meshed with each other with a predetermined backlash.

FIG. 1 shows best the way of force transmission when the developing unit 101 receives the driving force, in this embodiment, FIG. 1 shows the developing unit 101 as seen in the direction C in FIG. 8. For the best understanding, the drive base 124 and the gears and clutches of the driving system are omitted with the exception that the developing sleeve driving gear 157.

The developing unit 101 is moved to below the photosensitive drum 1 at the development operating timing, and simultaneously, it is urged to the slide guide 121 by force F1 and is rotated about an axis 200 (which corresponds to the pin 105R in FIG. 10) to be raised. Then, the developing sleeve driving gear 157 which is mounted on the drive supporting plate 122 (FIG. 3) coaxially with the pivot 200 drives the gear 104 of the developing unit, thus transmitting the driving force to rotate the developing sleeve. The gear 104 and the pivot 204 are positioned as shown in FIG. 1. More particularly, the pivot 200 is disposed at the right side of the gear 104 in FIG. 1 and at the same level as or above the center of the gear 104, and in addition, the rotational direction is such that the gear 104 rotates in the counterclockwise direction in FIG. 1, by which the developing unit 101 receives force F2 from the developing sleeve driving gear 157 as shown in the Figure.

The force F2 produces a clockwise moment about the pin 105R to assist the raising of the developing unit by the slide 121.

In this embodiment, the other pin (the pin 105F in FIG. 10) has the same structure as shown in FIG. 21.

The direct transmission of the rotational force to the developing unit at the supporting side (the pin 105R side) is effective to assuredly raise the developing unit. After the developing operation, the slide guide 121 and the developing sleeve driving gear 157 are released, upon which the developing unit 101 lowers with rotation by its weight.

According to the driving system in the present invention, the raising force provided by the raising mechanism can be reduced in connection with the spring force of the raising spring 110 which functions only to assuredly abut the front side, and therefore, the load of the raising mechanism is reduced. In addition, the impact or shock upon the raising action can be reduced, so that the image misregistration or the non-uniform pitch is reduced, thus improving the image quality. Furthermore, the noise or vibration in the raising operation can be reduced.

Figure 4:
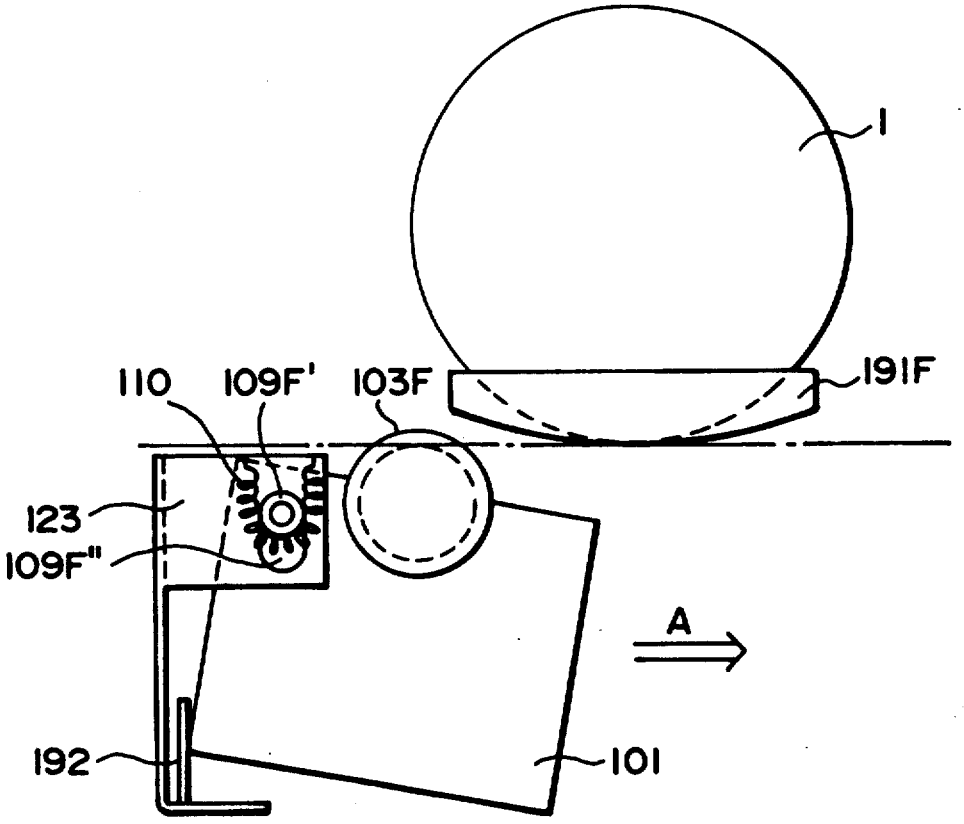
FIGS. 4 and 5 are side views illustrating a developing apparatus raising mechanism in an image forming apparatus according to a second embodiment of the present invention.
Figure 5:
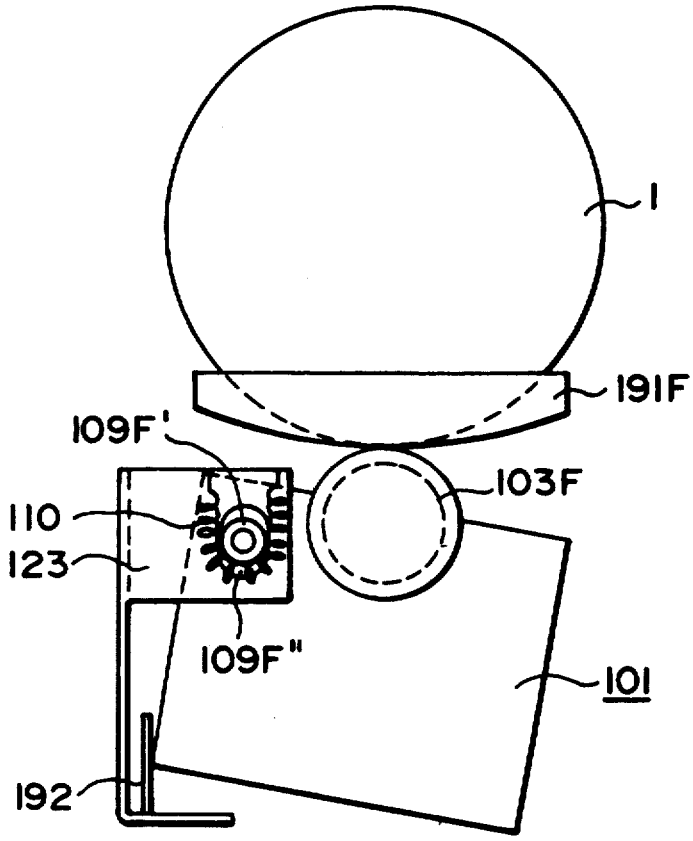

FIGS. 4–6 shows a further embodiment. In this embodiment, no particular mechanism is provided to rotate and raise the developing unit. When the developing unit is moved to a position below the photosensitive drum for the developing operation, an abutment member of the developing unit abuts the photosensitive drum or an abutment member correctly positioned relative to the photosensitive drum, by which the pivot of the developing unit urged upwardly is raised, so that the proper abutment pressure can be provided by the reaction. At the other pivot constructed for only rotation, the distance between the developing unit and the abutment member of the photosensitive drum is set to be so small that they are not contacted when the developing operation is not performed. Thus, only by the driving force for the developing sleeve driving gear, the rotational force is provided to abut them to each other.

Referring to FIGS. 4–6, only the portions which are different in the previous embodiment will be described. FIG. 4 shows the developing unit in this embodiment as seen from the front side. For the sake of simplicity, only one of the four developing units is shown. The apparatus of this embodiment does not have the mechanism for rotating the developing unit such as slide rails 121 or racks 140 as shown in FIGS. 8 and 13 of the previous embodiment. In place thereof, a stopper 192 is used to limit the rotation of the developing unit 101 to maintain the abutment roller 103F at a high position. In this structure, when the developing unit 101 is moved horizontally in the direction A by the movable base 120 not shown in FIG. 4, the front abutment roller 103F abuts an abutment member 191F correctly positioned relative to the photosensitive drum 1 so as to lower the pin 103F', when it reaches the operating position for the development, as shown in FIG. 5.

FIG. 6 shows the developing unit as seen from behind, that is, in the opposite direction from FIGS. 4 and 5. As will be understood from FIG. 6, an abutment member 191R is used at the rear side, similarly to the front side. When the developing unit is not driven, the abutment member 191R is slightly spaced apart from the abutment roller 103R. When the developing sleeve is driven by the driving gear 157 coaxial with the pivot 202 (corresponding to the pin 105R), the force F2 by the driving gear 157 rotates the developing unit against its weight, by which the abutment roller 103R abuts the abutment member 191R. At this time, the driving torque for the developing sleeve driving gear is required to be larger by the weight of the developing unit.

According to this embodiment, the developing unit may be abutted to the photosensitive drum 1 assuredly and can be correctly positioned relative thereto without particular mechanism for raising the developing unit.

The movement direction of the developing unit 101 toward and away from the photosensitive drum 1 is not limited to the horizontal direction, but may be vertical.

In the foregoing description of the embodiments, a full-color copying machine has been taken, but the present invention is applicable to a multi-color copying machine or a monochromatic copying machine, if one or more developing units are movable between an operating position for developing the photosensitive drum and a non-operative position.

As described in the foregoing, the developing unit of the image forming apparatus according to the present invention has plural pivot, one of which is movable and urged by urging means, and the pivots and a driving gear are so disposed that when the developing unit is moved, the developing unit is urged toward the image bearing member, by which the deformation of the urging member is assisted upon rotation of the developing unit. Therefore, the load imposed on the rotating mechanism can be reduced, so that the durability and reliability of the rotating mechanism is increased. In addition, the vibration during the rotation of the developing unit is reduced, and the correct positioning of the developing unit at the operating position is assured, which is effective to reduce the blurness and increases the image quality.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:
image bearing means;
means for forming an electrostatic latent image on said image bearing means;
developing means for developing a latent image formed on said image bearing means, said means including a developing unit having a developer carrying member for carrying thereon and supplying a developer to said image bearing means;
moving means for moving said developing unit between an operative position and a non-operative position away therefrom;
supporting means for supporting said developing unit for rotation about an axis, said supporting means rotatably supporting said developing unit at one side and supporting said developing unit at the other side for rotation and movement in a predetermined direction;
urging means for urging said developing unit toward said image bearing means adjacent to the other side; and
means for applying driving force to said developer carrying member of said developing unit at said one side;
wherein, when said developing unit is rotated about the axis and moved to the operating position by said moving means, said developing unit is urged toward said image bearing means about the axis by the driving force of said driving means, and
wherein said developing means has a plurality of such developing units.

2. An apparatus according to claim 1, wherein said plural developing units contain different color developers, respectively.

3. An apparatus according to claim 2, wherein said image forming apparatus forms a full-color image.

4. An apparatus according to claim 1, wherein the operative position is common to said plural developing units.

5. An apparatus according to claim 1, wherein said driving means comprises a driving gear for driving said developer carrying member, and wherein said driving gear is arranged coaxial with the axis of said developing unit.

6. An apparatus according to claim 5, wherein said driving gear is disposed at a position corresponding to one end of a shaft about which said developing unit is rotatable.

7. An apparatus according to claim 1, wherein said developing unit is movable toward and away from said image bearing means at the other side.

8. An apparatus according to claim 5, wherein the operating position is below said image bearing means.

9. An apparatus according to claim 8, wherein said developing unit has a gear mounted on said developer carrying member and engageable with said driving gear, and the enter of the gear of said developer carrying member is at the same height level as or above the axis of said developing unit.

10. An image forming apparatus, comprising:
image bearing means;
means for forming an electrostatic latent image on said image bearing means;
developing means for developing a latent image formed on said image bearing means, said means including a developing unit having a developer carrying member for carrying thereon and supplying a developer to said image bearing means;
moving means for moving said developing unit between an operative position and a non-operative position away therefrom;
supporting means for supporting said developing unit for rotation about an axis, said supporting means rotatably supporting said developing unit at one side and supporting said developing unit at the other side for rotation and movement in a predetermined direction;
urging means for urging said developing unit toward said image bearing means adjacent to the other side;
means for applying driving force to said developer carrying member of said developing unit; and
means for reciprocating the plural developing units along a rectilinear line;
wherein, when said developing unit is rotated about the axis and moved to the operating position by said moving means, and said driving means is operated, said developing unit is urged toward said image bearing means about the axis, and
wherein said developing means has a plurality of such developing units.

11. An apparatus according to claim 10, wherein said plural developing units are arranged on one movable base.

12. An apparatus according to claim 10, wherein said plural developing units are movable in a substantially horizontal plane below said image bearing means.

13. An apparatus according to any one of claims 1, 5, 6, 7 or 9, wherein said driving means applies to said developing unit a moment about the axis toward said image bearing member.

14. An image forming apparatus, comprising:
image bearing means;
means for forming an electrostatic latent image on said image bearing means;
developing means for developing a latent image formed on said image bearing means, said means including a developing unit having a developer carrying member for carrying thereon and supplying a developer to said image bearing means;
moving means for moving said developing unit between an operative position and a non-operative position away therefrom;
supporting means for supporting said developing unit for rotation about an axis, said supporting means rotatably supporting said developing unit at one side and supporting said developing unit at the other side for rotation and movement in a predetermined direction;
urging means for urging said developing unit toward said image bearing means adjacent to the other side; and
means for applying driving force to said developer carrying member of said developing unit;
wherein the operating position is below said image bearing means,
wherein, when said developing unit is rotated about the axis and moved to the operating position by said moving means, and said driving means is operated, said developing unit is urged toward said image bearing means about the axis, and wherein said developing means has a plurality of such developing units.

15. An image forming apparatus, comprising:

image bearing means;

means for forming an electrostatic latent image on said image bearing means;

developing means for developing a latent image formed on said image bearing means, said developing means including a developing unit having a rotatable developer carrying member for carrying thereon and supplying a developer to said image bearing means and also having a driving force receiving gear for rotating said developer carrying member;

supporting means for supporting said developing unit, said supporting means rotatably supporting said developing unit at one side and supporting said developing unit at the other side for rotation and movement in a direction toward and away from the image bearing means;

urging means for resiliently urging said developing unit toward said image bearing means adjacent the other side;

moving means for moving said developing unit by rotating said developing unit between an operative position and a non-operative position away therefrom; and a driving gear meshing with the driving force receiving gear of said developing unit for applying the driving force to the drive receiving gear, said driving gear being effective to apply the driving force to the drive receiving gear to rotate said developer carrying member and also effective to apply to said developing unit a moment for urging said developing unit toward said image bearing means.

16. An apparatus according to claim 15, wherein said drive receiving gear is disposed at said one side of said developing unit.

17. An image forming apparatus, comprising:

image bearing means;

means for forming an electrostatic latent image on said image bearing means;

developing means for developing a latent image formed on said image bearing means, said developing means including a developing unit having a rotatable developer carrying member for carrying thereon and supplying a developer to said image bearing means and also having a driving force receiving gear for rotating said developer carrying member;

supporting means for supporting said developing unit, said supporting means rotatably supporting said developing unit at one side and supporting said developing unit at the other side for rotation and movement in a direction toward and away from the image bearing means;

urging means for resiliently urging said developing unit toward said image bearing means adjacent the other side; and a driving gear meshing with the driving force receiving gear of said developing unit for applying the driving force to the drive receiving gear, said driving gear being effective to apply the driving force to the drive receiving gear to rotate said developer carrying member and also effective to apply to said developing unit a moment for urging said developing unit toward said image bearing means.

18. An apparatus according to claim 17, wherein said drive receiving gear is disposed at said one side of said developing unit.

* * * * *

UNITED STATES PATENT AND TRADEMARK OFFICE

CERTIFICATE OF CORRECTION

PATENT NO. : 5,202,739

DATED : April 13, 1993

INVENTOR(S) : HATAKEYAMA ET AL.

It is certified that error appears in the above-indentified patent and that said Letters Patent is hereby corrected as shown below:

Column 15, line 64,

CLAIM 9

Line 4, "enter" should read --center--.

COLUMN 3

Line 18, "and and" should read --and--.

COLUMN 7

Line 49, "positions" should read --position--.

COLUMN 10

Line 44, "are" should read --is--; and
Line 57, "hundreds" should read --hundred--.

COLUMN 12

Line 1, "elongates" should read --elongated--.

UNITED STATES PATENT AND TRADEMARK OFFICE

CERTIFICATE OF CORRECTION

PATENT NO. : 5,202,739

DATED : April 13, 1993

INVENTOR(S) : HATAKEYAMA ET AL.

It is certified that error appears in the above-indentified patent and that said Letters Patent is hereby corrected as shown below:

COLUMN 13

Line 15, "that" should read --of--; and
Line 57, "shows" should read --show--.

COLUMN 14

Line 55, "pivot," should read --pivots,--.

Signed and Sealed this

Twelfth Day of April, 1994

Bruce Lehman

*Attest:*

BRUCE LEHMAN

*Commissioner of Patents and Trademarks*

*Attesting Officer*